US005116053A

United States Patent [19]

Blankenburg et al.

[11] Patent Number: 5,116,053

[45] Date of Patent: May 26, 1992

[54] PUZZLE

[75] Inventors: Karl Blankenburg, 32131 Claeys Dr., Warren, Mich. 48093; Karl V. Blankenburg, 61830 Lantern Cove, Washington, Mich. 48094; Duane Rode, Oakland, Mich.

[73] Assignees: Karl Blankenburg, Warren; Karl Van Blankenburg, Washington, both of Mich.

[21] Appl. No.: 740,155

[22] Filed: Aug. 5, 1991

[51] Int. Cl.[5] ..... A63F 9/08

[52] U.S. Cl. ..... 273/153 S

[58] Field of Search ..... 273/153 S

[56] References Cited

U.S. PATENT DOCUMENTS 4,373,729 2/1983 Hanson et al. ..... 273/153 S
4,856,786 8/1989 Gyoval ..... 273/153 S
4,949,969 8/1990 Johnson ..... 273/153 S

FOREIGN PATENT DOCUMENTS

WO82/00101 1/1982 PCT Int'l Appl. .
1319888 6/1987 U.S.S.R. .
2107997 5/1983 United Kingdom .

*Primary Examiner*—William H. Grieb
*Attorney, Agent, or Firm*—Basile and Hanlon

[57] ABSTRACT

A self-contained puzzle includes an axially extending tube with first and second end caps mounted on opposite ends. A plurality of gears are concentrically and rotatably mounted about the tube between the first and second end caps. Slide support elements on each of the gears form channels therebetween which slidably receive a slide element which is manipulatable from a channel in one gear to an aligned, empty channel in an adjacent gear. The exterior surfaces of the slide elements form a mosaic when assembled and contain indicia forming a puzzle or design. Releasable lock members are unitarily formed on one of the tube or each gear and releasably engage axially extending grooves formed in the other of the tube and each gear to temporarily lock each gear in a selected angular position about the tube relative to adjacent gears.

17 Claims, 4 Drawing Sheets

PUZZLE

BACKGROUND OF THE INVENTION

1. Field of the Invention

The present invention relates, in general, to puzzles and, more specifically, to puzzles containing a plurality of pieces limitedly movable within a frame.

2. Description of the Art

Many different varieties of three-dimensional puzzles are well-known in which a plurality of pieces are slidably mounted within a frame and manipulatable into different positions within the frame to solve the puzzle by arranging the pieces which carry various forms of indicia into a predetermined pattern.

U.S. Pat. No. 4,949,969 discloses such a puzzle. This puzzle is self-contained and is in the form of a cylinder. A plurality of individually rotatable base wheels are mounted concentrically end-to-end about a tubular axle. An endmost base wheel includes an outwardly opening female fitting which receives a complimentarily-shaped male fitting formed on an end cap.

Each base wheel includes an inner cylindrical hub collar having a plurality of radially inward facing detent grooves formed therein facing the axle. A series of spaced, spring-biased detent mechanisms are mounted in the axle and are each engageable with one of the grooves in the hub collar of each base wheel to temporarily hold each base wheel in a selected angular position about the axle with respect to adjacent base wheels.

A plurality of mortise grooves are formed in the outer surface of each base wheel and slidably receive a dove-tail tenon formed on one of a plurality of slide elements slidably mountable on each base wheel. Each slide element is axially slidable along the mortise groove of one base wheel into the mortise groove of an adjacent base wheel when the grooves of the two base wheels are aligned.

Each slide element has an arcuate-shaped outer face from which the dove-tail tenon projects. Various indicia, such as designs, colors, numerals, etc., are formed on the exterior face of each slide element to create a complete design when the slide elements are arranged in a generally cylindrical mosaic form on the base wheels. One mortise groove in one base wheel is initially free of a slide element to enable a slide element from an adjacent base wheel to be slid into the open groove. This enables the slide elements to be repositioned, one at a time, on the cylinder to solve the puzzle.

While this puzzle is challenging in reaching a solution and is easy to manipulate, it is believed that further improvements could be made to it to lower its manufacturing cost, reduce its assembly time and to improve its reliability.

The puzzle disclosed in U.S. Pat. No. 4,949,969 uses spring-biased balls as a detent mechanism for each base wheel. This structure involves a number of separate parts which add to the cost of the puzzle. Further, the insertion of the spring and ball into each bore in the axle and the alignment with and the insertion of each base wheel over the ball and into engagement with the detent is tedious and requires careful, time consuming labor. These factors add to the time required to assemble the puzzle which further increases its manufacturing cost.

The separate detent mechanisms are also susceptible to breakage which could damage the puzzle and render it inoperative or difficult to manipulate. Further, one of the end caps is a separate element which is attached to the endmost base wheel via an interconnecting male-female fitting. This requires a special design for one of the base wheels and additional material to form the fitting. Further, there is a possibility of separation of the fitting which could result in the loss of some of the slide elements or base wheels.

Thus, it would be desirable to provide a puzzle including a plurality of repositionable elements mounted in a frame or support structure which improves the design of previously devised puzzles with respect to the simplicity of the puzzle design, reduced manufacturing costs due to a minimal number of separate elements, and one which makes assembly easier and less time consuming.

SUMMARY OF THE INVENTION

The present invention is a puzzle containing a plurality of individually repositionable pieces mounted in a support structure.

The puzzle includes a tube having a side wall and first and second opposed ends. First and second end caps are fixedly mounted on the first and second ends, respectively, of the tube. A plurality of gears are rotatably and concentrically mounted on the side wall of the tube between the first and second end caps. Each gear is independently rotatable with respect to the other gears about the longitudinal axis of the tube. A lock means is formed on the tube and each gear for temporarily locking each gear in a selected angular position on the tube. The lock means includes a plurality of planar, parallel, open-ended grooves formed in one of the tube and each gear and at least one resilient lock member unitarily formed on the other of the tube and each gear and releasably engaging one of the grooves.

A plurality of circumferentially spaced slide support members are formed on and extend radially outward from each gear. Each slide support member has a pair of opposed side faces. The opposed side faces of two circumferentially adjacent slide support members form a channel therebetween.

A plurality of slide elements are provided for each gear and have an exterior, arcuate surface and a depending leg. The leg has a shape complimentary to and slidably engageable with a channel between two adjacent slide support members in each gear. The exterior surfaces of all of the plurality of slide elements are arranged in a cylindrical-shaped mosaic on the gears between the first and second end caps, with one channel in the plurality of gears being void of a slide element to form an opening into which a slide element in an adjacent positioned gear can be axially slid in the direction of the longitudinal axis of the tube to enable any or all of the slide elements to be individually repositioned about the tube into a predetermined pattern.

In an exemplary embodiment, the grooves are formed in the tube and extend between the first and second ends of the tube in parallel with the longitudinal axis of the tube. At least one resilient lock member is formed on each gear and projects radially inward toward the tube.

In a preferred embodiment, one of the end caps is unitarily molded as an integral part of the plastic tube. The other end cap has an annular rib extending from an interior side which is engageable with the inner diameter of the side wall of the tube to center and position the other end cap on the tube. The other end cap is then fixed to the tube by welding or other suitable fastening means.

Preferably, each gear comprises an annular ring formed of individual arcuate segments unitarily connected end-to-end. The slide support members are formed on and project radially outward from the annular ring. A portion of the lock means is positioned radially inward of and connected to the annular ring.

The slide support members, in one exemplary embodiment, comprise a leg, a perpendicular rib attached to one end of the leg and two angular flanges mounted on opposite side ends of the rib. The angular flanges are disposed at obtuse angles with respect to the rib which, with the opposed rib of an adjacent slide support member, forms a channel between two opposed flanges.

The releasable lock means comprises a thin strip having opposed ends connected to one of the tube at the mounting position of each gear or to each gear. The strip is spaced from the adjacent portion of the tube or gear to which it is attached at the opposed ends and includes a projection which is releasably engageable with the grooves.

In assembling a preferred embodiment of the puzzle of the present invention, one of the gears is disposed over the tube, with the projections in the resilient lock means engaged with the grooves in the tube. The gear is pushed along the length of the tube into engagement with the unitary first end cap. The slide elements are then inserted into the channels in the gear. The remainder of the gears are then mounted over the tube in a similar manner, with the slide elements of each gear inserted therein. As described above, one of the channels in at least one of the gears is left void of a slide element. The second end cap is then fixedly attached to the opposite end of the tube to complete the puzzle and to securely retain the gears and slide elements thereon in a freely movable manner.

In use, a slide element of one of the gears is slid into the vacant channel in an adjacent gear and then certain of the gears rotated to bring another slide element into position adjacent the newly opened channel. As each of the gears is independently rotatable about the tube, the slide elements on all of the gears may be individually and sequentially manipulated by a user to arrange the slide elements in a desired pattern to solve the puzzle. The pattern may take any form, such as a particular design, a numeric arrangement, or the trade dress of a conventional beverage can.

The puzzle of the present invention has a simplified construction compared to similar previously devised puzzles due to the unitary lock means integrally molded on the tube or on each gear. This unitary construction eliminates the multitude of separate parts employed in similar prior art puzzles and substantially reduces assembly time and manufacturing costs as the gears are merely aligned with and inserted over the tube.

The unitary construction of the present puzzle also provides reliable operation due to the integral formation of the lock means on each gear. Any indicia may be formed on the slide elements including numeric puzzles, designs of well-know objects, i.e., beverage cans with a manufacturer's trade dress or design.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 1:
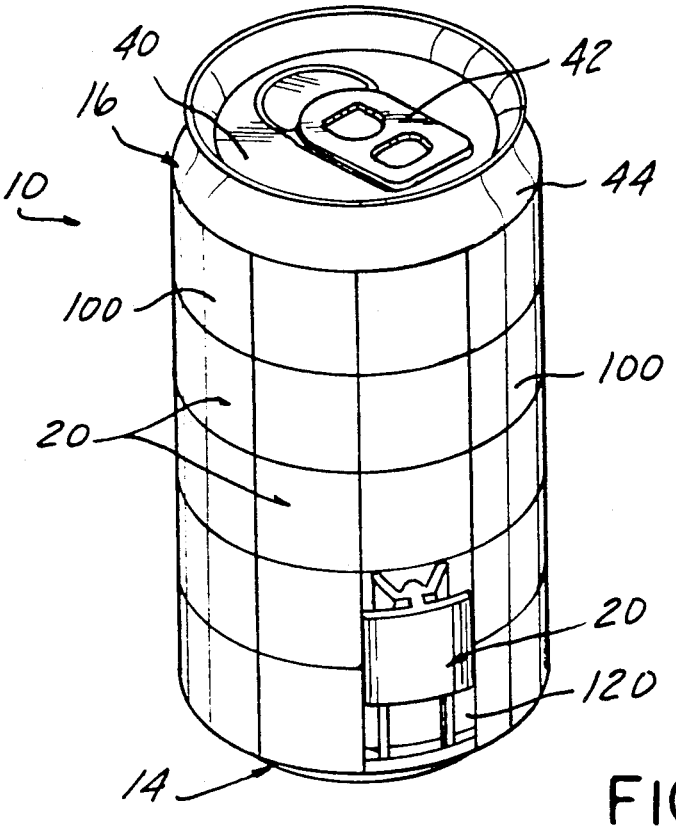
FIG. 1 is a perspective view of the puzzle of the present invention.
Figure 2:
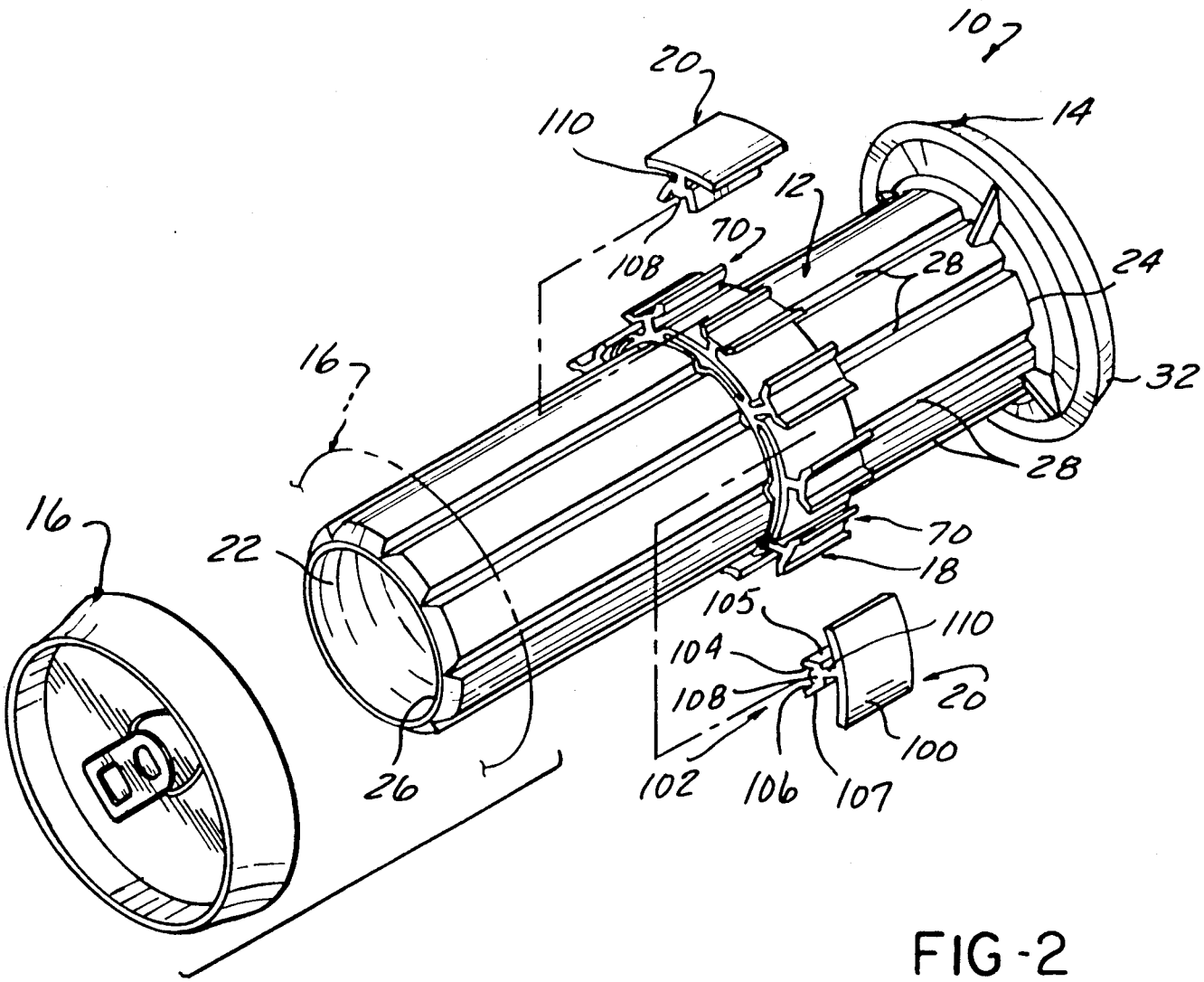
FIG. 2 is an exploded, perspective view showing the components of the puzzle depicted in FIG. 1 with only one gear and two slide elements being shown for clarity.

Referring now to the drawing, and to FIGS. 1 and 2 in particular, there is illustrated a puzzle 10 constructed in accordance with the teachings of the present invention. The puzzle 10 generally includes a tube 12, first and second end caps 14 and 16, respectively, a plurality of gears 18 rotatably mounted about the tube 12, and a plurality of individually movable slide elements 20 slidably mounted on each gear 18.

Figure 3:
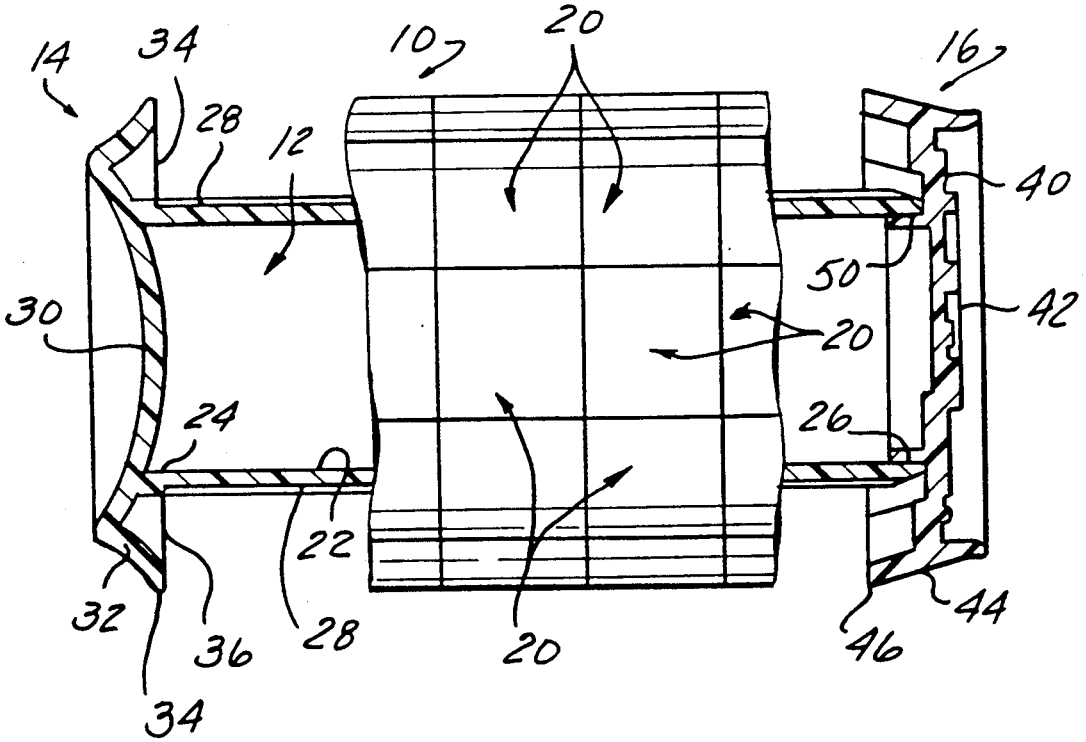
FIG. 3 is a partially cross sectioned, partially broken away, side elevational view of the puzzle shown in FIG. 1.

The tube 12 is in the form of an elongated, cylindrical, preferably hollow member which is formed of a suitable plastic material, such as ABS, styrene, polyester, etc. The tube 12 has a side wall 22 and first and second ends 24 and 26, respectively. Due to the hollow construction of the tube 12, the first and second ends 24 and 26 of the tube 12 are open as shown in FIGS. 2 and 3. Further, as shown in a preferred embodiment in FIGS. 2, 3 and 4, a plurality of elongated grooves 28 are formed in the side wall 22 of the tube 12 and extend axially along the length of the tube 12 between the first and second ends 24 and 26. The grooves 28 are disposed in parallel to the longitudinal axis of the tube 12 and open outward away from the longitudinal axis of the tube 12 in a substantially V-shape. The V-shape is depicted as an example only, as the grooves 28 may have other shapes, such as arcuate, sinuous, etc. Further, the grooves 28 may be provided in any desired number on the tube 12, with the number of grooves 28 being selected to provide a desired number of individual slide elements 20 in the complete puzzle 10, as described hereafter.

The first and second end caps 14 and 16 are fixedly connected to the first and second ends 24 and 26, respectively, of the tube 12. The end caps 14 and 16 close off the open first and second ends 24 and 26 of the tube 12 and retain the gears 18 and slide elements 20 on the tube 12.

Figure 4:
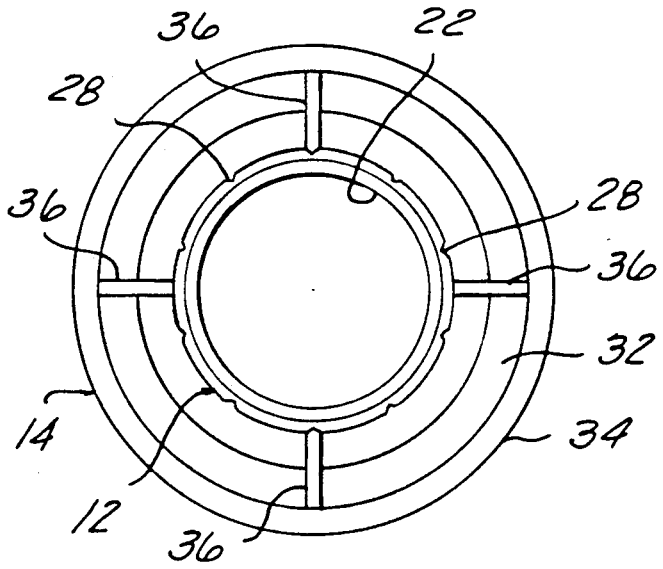
FIG. 4 is an end view of the tube and first end cap of the puzzle shown in FIG. 2.

As shown in FIGS. 3 and 4, the first end cap 14, which is the bottommost end cap in the orientation of the puzzle 10 shown in FIG. 1, is unitarily, integrally molded with the tube 12. Since the puzzle 10 is depicted in FIG. 1 as having the shape of a conventional beverage can, the first end cap 14 has a shape simulative of the bottom of a conventional beverage can. Thus, as shown in FIGS. 3 and 4, the first end cap 14 includes a base wall 30 which has a generally concave or arcuate shape. A side wall 32 extends angularly outward from the circumferential edge of the base wall 30. The peripheral edge 34 of the side wall 32 is spaced from the side wall 22 of the tube 12 for reasons which will be described in greater detail hereafter. A plurality of radially extending ribs 36 are integrally formed on one side of the first end cap 14 and extend inward from the peripheral edge 34 to the side wall 22 of the tube 12 for additional rigidity as well as to prevent the slide elements 20 and the endmost gear 18 from sliding inward under the peripheral edge 34 of the first end cap 14.

It will be understood that although the first end cap 14 has been described as being unitarily, integrally molded with the tube 12, the first end cap could also be formed as a separate member which is fixedly connected to the first end 24 of the tube 12 via suitable means, such as by an adhesive, sonic welding, vibration welding, heat welding, etc.

Figure 5:
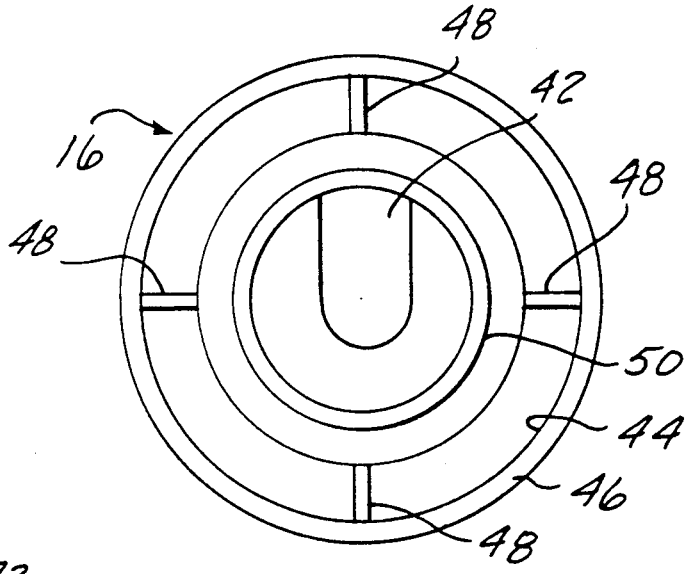
FIG. 5 is a bottom view of the second end cap shown in FIG. 2.

The second end cap 16 is constructed as a separate member which is attached to the second end 26 of the tube 12 by suitable means, such as an adhesive, sonic welding, vibration welding, heat welding, etc. As shown in FIGS. 1, 2, 3 and 5, the second end cap 16, in the beverage can embodiment of the puzzle 10, is configured to simulate the top end of a beverage can. Thus, the second end cap 16 has a top wall 40 with a unitary pull tab design 42 formed therein. A side wall 44 extends away from the edge of the top wall 40. The side wall 44 tapers outwardly from the top wall 40 to an enlarged diameter second end having a peripheral edge 46, as shown in FIGS. 3 and 5. The peripheral edge 46 is spaced from the side wall 22 of the tube 12 when the second end cap 16 is fixed to the tube 12 to retain the slide elements 20 and gears 18 on the tube 12.

A plurality of outer, radially extending ribs 48 are formed on one side of the top wall 40 of the second end cap 16 and engage the end of the slide elements 20 and an endmost gear 18 to retain the slide elements 20 and the endmost gear 8 on the tube 12. A second, inner rib 50 is also integrally formed on the same side of the top wall 40 of the second end cap 16. Preferably, the second, inner rib 50 is in the form of an annular ring having a diameter complimentary to the inside diameter of the second end 26 of the hollow tube 12. The annular ring 50 fits into the inside of the second end 26 of the tube 12 as shown in FIG. 3 to center and support the second end cap 16 on the tube 12. Adhesive or various forms of welding, such as sonic, vibration or heat welding, is applied between the second rib 50 and the side wall 22 adjacent the second end 26 of the tube 12 to fixedly connect the second end cap 16 to the second end 26 of the tube 12. It will be noted that the second end cap 16 is fixedly connected to the tube 12 after all of the gears 18 and slide elements 20 have been mounted on the tube 12, as described hereafter.

Figure 6:
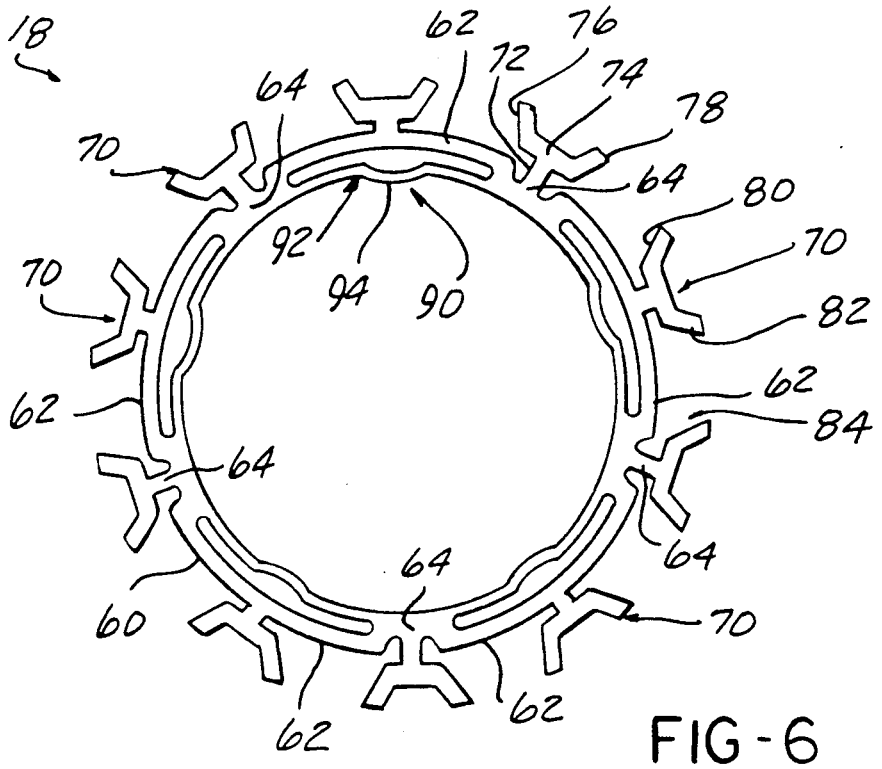
FIG. 6 is a front elevational view of one of the gears shown in FIG. 2.
Figure 7:
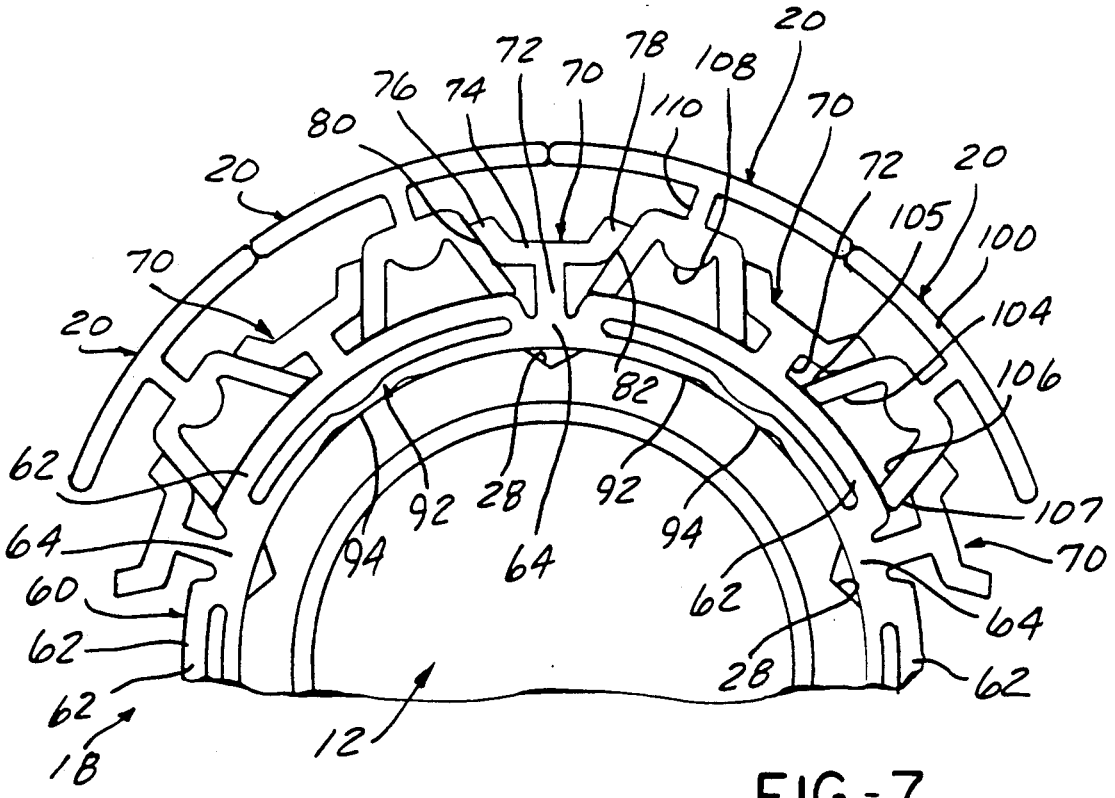
FIG. 7 is an enlarged, partial view showing the mounting of the slide elements on one gear and the tube.

As shown in FIGS. 2, 6 and 7, each gear 18 is identically constructed and includes an annular ring-like member 60. In a preferred embodiment, the annular ring 60 is formed of a plurality of arcuate, circumferentially spaced, interconnected segments 62. The segments 62 are equi-radially spaced from the longitudinal axis of the gear 18 and are interconnected at opposite ends to circumferentially spaced anchor portions denoted by reference number 64. The anchor portions 64 generally comprise an enlarged portion of the annular ring 60 and extend, preferably, the entire width of each gear 18 as do the arcuate segments 62. As shown in FIGS. 6 and 7, the anchor portions 64 extend slightly radially inward from the segments 62.

A plurality of slide support members denoted in general by reference number 70 are unitarily, integrally molded on each gear 18 and are connected to the annular ring 60. The slide support members 70 slidably support the slide elements 20 on each gear 18, as described hereafter. As each slide support member 70 is identically constructed, and differs only in its place of attachment to the annular ring 60 on each gear 18, only one of the slide support members 70 will be described in detail hereafter. As shown in FIGS. 6 and 7, each slide support member 70 includes a leg 72 projecting radially outward from the annular ring 60. Alternate legs 72 on each gear 18 are unitarily connected to the anchor portion 64 of the ring 60 and centrally on each arcuate segment 62. A rib 74 is formed at one end of each leg 72 and extends substantially perpendicular therefrom. A pair of outwardly projecting flanges 76 and 78 are formed at the outer ends of the rib 74. Preferably, and by way of example only, the flanges 76 and 78 are disposed at obtuse angles with respect to the rib 74. This configures the flanges 76 and 78 at an angle with respect to the leg 72 of each slide support member 70. Other angles, such as acute angles, may also be provided for the flanges 76 and 78. Further, the flanges 76 and 78 and the ribs 74 may be formed as a solid member with no recess or indentation, as shown in FIGS. 6 and 7, formed therein. All that is required is that the flanges 76 and 78 have angularly disposed side surfaces denoted in general by reference numbers 80 and 82, respectively.

The exterior side surfaces 80 and 82 of each slide support member 70 are spaced from corresponding side surfaces 80 and 82 of adjacent slide support members 70. Two opposed side surfaces 80 and 82 of two adjacent slide support members 70 form a channel therebetween having a predetermined shape as denoted by reference number 84 in FIG. 6. The channel 84 is sized to slidably receive one of the slide elements 20 as described hereafter. The channel 84 may have other shapes, such as an inverted T-slot, etc., to slidably retain the slide elements 20 on each gear 18.

The puzzle 10 includes lock means formed on the tube 12 and each gear 18 for temporarily locking each gear 18 in a selected angular position on the tube 12. The lock means includes a plurality of planar, parallel, open-ended grooves 28 formed in one of the tube 12 or on each of the gears 18. At least one resilient lock member 90 is unitarily formed on the other of the tube 12 or on each gear 18 for releasably engaging one of the grooves. Although the following description describes one embodiment of the present puzzle 10 in which the grooves 28 are formed in the tube 12 and the lock members 90 are formed on each gear 18, it will be understood that an opposite construction in which the grooves 28 are formed in each gear 18 and the lock members 90 are formed on the tube 12 at each gear 18 mounting position is also within the scope of the present invention.

Thus, in one embodiment, the resilient locking member denoted in general by reference number 90 in FIG. 6 is unitarily formed on each gear 18 and is disposed radially inward of the annular ring 60. The resilient lock member 90 includes at least one and, preferably, a plurality of equi-circumferentially spaced strips 92. Each strip 92 has opposite ends which are unitarily formed with or joined to the anchor portions 64 on the annular ring 60 of each gear 18. Further, each strip 92 is preferably narrow in width so as to extend for only a small portion of the width of the gear 18. Alternately, however, each strip 92 may extend the entire width of the gear 18.

As shown in FIGS. 6 and 7, each strip 92 is spaced from the adjacent segment 62 of the annular ring 60. Each strip 92 further has a generally arcuate shape slightly larger than the outside diameter of the tube 12, with a centrally located, radially inward extending projection 94 formed thereon.

The gear 18, including the annular ring 60, the slide support members 70 and the resilient lock member 90, is preferably formed of a suitable material which exhibits shape memory. An exemplary embodiment of such a material is acetal resin. In this manner, the resilient lock member 90 can be deformed as the gear 18 is rotated about the tube 12 toward and away from the adjacent arcuate segment 62 to bring the projection 94 on each strip 92 into and out of engagement with one of the grooves 28 in the tube 12 to thereby releasably and temporarily lock each gear 18 in a selected angular position on the tube 12.

Figure 8:
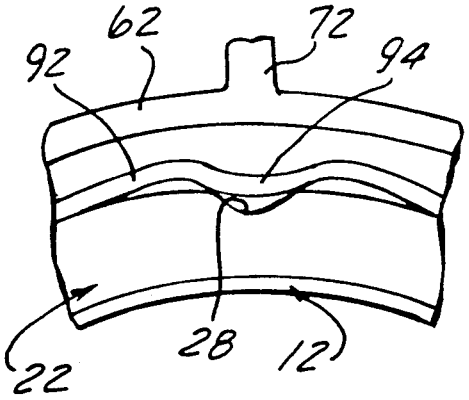
FIG. 8 is a partial, enlarged view showing the releasable interconnection of the lock means of one gear to the tube.
Figure 9:
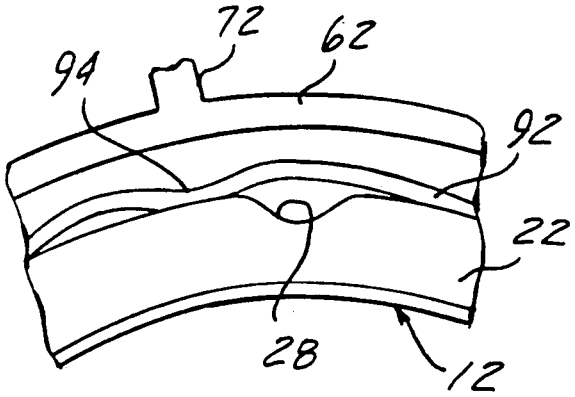
FIG. 9 is a partial, enlarged view showing the position of the lock means and tube grooves during rotation of a gear about the tube.

This operation is illustrated in greater detail in FIGS. 8 and 9. In FIG. 8, the projection 94 on one the strips 92 is depicted as being engaged in a groove 28 on the tube 12. This temporarily locks the gear 18 on which the strip 92 is unitarily formed in a selected angular position on the tube 12. However, when the gear 18 is rotated by a user about the longitudinal axis of the tube 12, or in a counterclockwise direction as shown in FIG. 9, the rotative force applied by the user will cause the projection 94 on the strip 92 to be forced out of engagement with the groove 28 such that the strip 92 and the projection 94 are urged toward the adjacent arcuate segment 62 on the gear 18. During continued rotation of the gear 18 about the tube 12, the projection 94 slides across the exterior surface of the tube 18 until it encounters and engages an adjacent groove 28. In this manner, each gear 18 may be rotated in either clockwise or counterclockwise directions about the longitudinal axis of the tube 12 and releasably positioned in any angular position by engagement between the projection 94 on the resilient lock member 90 and one of the grooves 28 in the tube 12.

The detailed construction of the slide elements 20 is shown in FIGS. 2 and 7. In the exemplary embodiment described above, ten slide elements 20 are slidably mounted on each gear 18. It will be understood that other puzzle designs which include a different number of slide elements are also within the scope of the present invention.

Each slide element 20 has an exterior surface 100. Various indicia, such as letters, numerals, or portions of an overall design, such as the trade dress of a beverage can, are placed on the exterior surface 100. The exterior surface 100 is generally arcuate and, in conjunction with the exterior surfaces 100 of all of the slide elements 20, forms a cylindrical mosaic as shown in FIG. 1.

Leg means 102 depends from the exterior surface 100 of each slide element 20. The leg means 102 preferably comprises a pair of angularly disposed, depending legs 104 and 106 which are unitarily, integrally joined to the exterior surface 100. In an exemplary embodiment, the legs 104 and 106 depend from an enlarged boss 108 formed at one end of a thin rib 110 joined to and extending from the exterior surface 100 The exterior surfaces 105 and 107 of each of the legs 104 and 106, respectively, slidably engage the exterior surfaces 80 and 82 of the slide support members 70 to slidably mount each slide element 20 in the channel 84 formed between adjacent slide support members 70. This enables each slide element 20 to be moved through aligned channels 84 in adjacent gears 18 from gear to gear to solve the puzzle 10.

The leg means 102 may also have other shapes, such as an inverted T-shape, etc., for retentive, sliding mounting in each gear 18.

In assembling the puzzle 10 of the present invention, the gears 18 are slidably disposed over the tube 12 one-at-a-time, with the first mounted gear 18 being disposed in registry with the first end cap 14. The slide elements 20 are disposed on each gear 18, preferably after each gear 18 has been individually mounted on the tube 12. After all of the gears 18 and slide elements 20 have been mounted on the tube 12, the second end cap 16 is mounted to the second end 26 of the tube 12 and fixedly connected thereto. In this configuration, the peripheral edge 34 of the first end cap 14 and the peripheral edge 46 of the second end cap 16 are substantially continuous with the exterior faces 100 of the slide elements 20.

It should be noted that when assembling the slide elements 20 on the gears 18, prior to the attachment of the second end cap 16 to the tube 12, at least one of channels 84 in at least one of the gears 18 is void of a slide element 20 This provides an opening denoted by reference number 120 in FIG. 1 into which a slide element 20 adjacent to the opening 120 may be slid from an adjacent gear 18. This opening 120 which shifts about the puzzle 10 enables the position of the slide elements 20 to be rearranged to solve the puzzle defined by the indicia formed on the exterior surfaces 100 of all of the slide elements 20. Such indicia may take the form of a conventional numeric or alpha numeric puzzle which requires the letters or numbers to be rearranged into a desired configuration to solve the puzzle. Alternately, the indicia may be in the form of a simulated object, such as a conventional beverage can containing the trade dress of a well-known brand of beverage.

In summary, there has been disclosed a unique puzzle which contains a plurality of individual, repositionable indicia carrying elements which are moved about to solve the puzzle. The puzzle is formed of a minimal number of individual elements and includes self-contained lock means to releasably and temporarily position the gears in a desired angular position about the tube of the puzzle. This minimizes the number of separate pieces which are required to form the puzzle thereby reducing manufacturing costs as well as the assembly time of the puzzle.

What is claimed is:

1. A puzzle comprising:

a tube having a side wall and first and second opposed ends;

first and second end caps fixedly mounted on the first and second ends, respectively, of the tube;

a plurality of gears rotatably and concentrically mounted on the tube between the first and second end caps, each gear being independently rotatable from the other gears about the longitudinal axis of the tube;

a plurality of circumferentially spaced slide support members mounted on and extending radially outward from each gear, each slide support member having opposed side surfaces, the opposed side surfaces of two circumferentially adjacent slide support members forming a channel therebetween:

lock means formed on the tube and each gear, for temporarily locking each gear in a selected angular position on the tube, the lock means including:

a plurality of planar, parallel, open-ended grooves formed in one of the tube and each gear; and at least one resilient lock member unitarily formed on the other of the tube and each gear and associated with each gear, the lock member releasably engaging one of the grooves, the lock member including:

a strip-like member having first and second opposed ends, the first and second ends being connected to one of the tube and each gear, the strip-like member being spaced from the adjacent portion of the one of the tube and the gear to which it is connected between the first and second ends thereof; and a radially extending projection formed on the strip-like member releasably engageable with one of the grooves as the gear is rotated about the tube; and a plurality of slide elements, each slide element having an exterior, arcuate surface and a depending leg, the leg having a shape complimentary to and slidably engageable with the channel between two adjacent slide support members in each gear, the exterior surfaces of all of the plurality of slide elements being arranged in a cylindrical-shaped mosaic on the gears between the first and second end caps, with at least one channel in the plurality of gears being free of a slide element to form an opening into which a slide element in an adjacent gear can be slid axially in the direction of the longitudinal axis of the tube.

2. The puzzle of claim 1 wherein:

each gear comprises an annular ring, the slide support members formed on and projecting radially outward from the annular ring, and a portion of the lock means formed on and facing radially inward from the annular ring.

3. The puzzle of claim 2 wherein:

the annular ring is formed of a plurality of arcuate segments connected at opposite ends to each other.

4. The puzzle of claim 3 wherein:

the first and second ends of the strip-like members are connected to the juncture of certain of the arcuate segments of the annular ring.

5. The puzzle of claim 4 further comprising:

a plurality of identical, circumferentially spaced strip-like members connected at opposite ends to the annular ring; and the projections on the plurality of strip-like members each simultaneously engaging one of the grooves on the tube.

6. The puzzle of claim 2 wherein the lock means comprises:

the grooves formed on the tube and extending between the first and second ends of the tube in parallel with the longitudinal axis of the tube; and the at least one resilient lock member formed on the annular ring of each gear and projecting radially inward from the annular ring toward the tube.

7. The puzzle of claim 6 wherein:

the first and second ends of the strip-like member are connected to the annular ring of each gear, the strip-like member being spaced from the annular ring between the first and second ends thereof; and the radially inward extending projection formed on the strip-like member being releasably engageable with one of the grooves in the tube as the gear is rotated about the tube.

8. The puzzle of claim 2 wherein each slide support member comprises:

a leg joined to and projecting radially outward from the annular ring;

a rib mounted on one end of the leg opposite from the end connected to the annular ring and disposed substantially perpendicular to the leg;

a pair of flanges mounted on the opposite ends of the rib and angularly disposed with respect to the rib and the leg, the flanges forming the side surfaces of the slide support member; and wherein the leg of each slide element includes first and second legs unitarily joined to and depending from the exterior surface of the slide element, the first and second legs being angularly disposed with respect to each other and forming the side surfaces of the slide element.

9. The puzzle of claim 8 wherein:

the flanges on the slide support member are disposed at obtuse angles with respect to the rib; and the first and second legs of each slide element are disposed at an acute angle with respect to each other.

10. The puzzle of claim 1 wherein:

the lock member is formed of a material having a shape memory.

11. The puzzle of claim 10 wherein the lock member is formed of acetal resin.

12. The puzzle of claim 1 wherein:

the first end cap is unitarily formed with the tube.

13. The puzzle of claim 12 wherein:

the second end cap includes rib means engageable with the second end of the tube for centering the second end cap on the second end of the tube.

14. The puzzle of claim 13 wherein:

the tube is hollow; and the rib means comprises an annular rim formed on the second end cap and engageable with the inner portion of the side wall of the second end of the tube.

15. The puzzle of claim 12 wherein:

each of the first and second end caps have an outer peripheral edge spaced radially outward from the side wall of the tube, the outer peripheral edge of the first and second end caps being substantially contiguous with the exterior surface of the slide elements when the slide elements are mounted on the gears on the tube.

16. A puzzle comprising:

a hollow tube having a side wall and first and second opposed ends, a plurality of planar grooves formed in the side wall of the tube and extending parallel to the longitudinal axis of the tube, the grooves opening radially outward from the longitudinal axis of the tube;

a first end cap unitarily formed with and joined to the first end of the tube;

a second end cap fixedly connected to the second end of the tube;

a plurality of gears rotatably and concentrically mounted on the tube between the first and second end caps, each gear being independently rotatable from the other gears about the longitudinal axis of the tube, each gear including:

an annular ring formed of a plurality of end-to-end connected arcuate segments;

releasable lock means unitarily joined to the annular ring for temporarily locking each gear in a selected angular position on the tube, the resilient lock means including a plurality of circumferentially spaced, arcuate strips connected at opposite ends to the juncture of certain arcuate segments and spaced between the opposite ends thereof from the adjacent arcuate segment, a projection formed on each strip engageable with one of the grooves in the tube; and a plurality of circumferentially spaced slide support members mounted on and extending radially outward from the arcuate segments, each slide support member including:

a leg joined to and projecting radially outward from the annular ring;

a rib mounted on one end of the leg opposite from the end connected to the annular ring and disposed substantially perpendicular to the leg; and a pair of flanges mounted on the opposite ends of the rib and angularly disposed with respect to the rib and the leg, the flanges forming side surfaces of the slide support member; and a plurality of slide elements, each slide element having an exterior, arcuate surface and depending first and second angularly disposed legs forming opposed angularly disposed side surfaces complimentary to and slidably engageable with the opposed surfaces of the slide support members in each gear when a slide element is mounted in a channel on a gear, the exterior surfaces of all of the plurality of slide elements being arranged in a cylindrical-shaped mosaic on the gears between the first and second end caps, with at least one channel in the plurality of gears being free of a slide element to form an opening into which a slide element in an adjacent gear can be slid axially in the direction of the longitudinal axis of the tube.

17. The puzzle of claim 16 wherein each gear, including the arcuate segments, the slide support members and the resilient lock means, is formed of a material having shape memory.

* * * * *